US011854758B2

(12) United States Patent
Zou et al.

(10) Patent No.: US 11,854,758 B2
(45) Date of Patent: Dec. 26, 2023

(54) CONTACTOR

(71) Applicant: Tyco Electronics (Shanghai) Co. Ltd., Shanghai (CN)

(72) Inventors: Teng Zou, Shenzhen (CN); Xiaoning Zhang, Shenzhen (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 143 days.

(21) Appl. No.: 17/392,726

(22) Filed: Aug. 3, 2021

(65) Prior Publication Data

US 2022/0044899 A1 Feb. 10, 2022

(30) Foreign Application Priority Data

Aug. 7, 2020 (CN) ..... 202021628554.3

(51) Int. Cl.
*H01H 67/02* (2006.01)
*H01H 50/60* (2006.01)

(52) U.S. Cl.
CPC ..... *H01H 50/60* (2013.01)

(58) Field of Classification Search
CPC ..... H01H 50/60; H01H 1/62; H01H 1/2041; H01H 9/34; H01H 9/443; H01H 50/546; H01H 9/32; H01H 73/18; H01H 3/40; H01H 73/045
USPC ..... 335/127
See application file for complete search history.

(56) References Cited

U.S. PATENT DOCUMENTS

2006/0119455 A1* 6/2006 Park ..... H01H 1/205 335/16
2020/0098528 A1* 3/2020 Zhang ..... H01H 1/221
2020/0098530 A1* 3/2020 Zhang ..... H01H 73/18

FOREIGN PATENT DOCUMENTS

CN 208622653 U * 3/2019 ..... H01H 1/2041
CN 211428099 U * 9/2020 ..... H01H 1/2041
WO WO-2018220124 A1 * 12/2018 ..... H01H 1/18
WO WO-2019121986 A1 * 6/2019 ..... H01H 1/2041

* cited by examiner

*Primary Examiner* — Shawki S Ismail
*Assistant Examiner* — Lisa N Homza
(74) *Attorney, Agent, or Firm* — Barley Snyder

(57) ABSTRACT

A contactor includes two static contacts and a movable contact. Two ends of the movable contact selectively electrically contact the two static contacts, respectively. The contactor further includes a rotatable member rotatable about a central axis, with the movable contact being mounted thereon. The rotatable member is rotatably mounted on a support plate. Two ceramic members are mounted on the support plate, with each defining an internal region. Two permanent magnets are mounted on the support plate and located outside of the two ceramic members, respectively. The two ends of the movable contact are located in respective internal regions of the two ceramic members, such that an electrical arc generated between the movable contact and the static contact is located within the internal region.

21 Claims, 2 Drawing Sheets

CONTACTOR

CROSS-REFERENCE TO RELATED APPLICATIONS

This application claims the benefit of Chinese Patent Application No. 202021628554.3 filed on Aug. 7, 2020, the whole disclosure of which is incorporated herein by reference.

FIELD OF THE INVENTION

The present disclosure relates to an electrical switches, and particularly, to a high-voltage direct current (DC) contactor.

BACKGROUND

As the state of contacts of a switch or a control electrical appliance are changed (e.g., opened or closed), they discharge and often generate an electrical arc. The generation of an electrical arc is undesirable for multiple reasons. For example, arc generation creates a delay in the switching operation of the circuit, it can burn the contacts of the switch and possibly result in the fusion welding thereof, and may even cause the switch or the control electrical appliance to catch fire in severe cases. Thus, arc extinguishing structures for switching electrical contacts are often desired.

Arc extinguishing structures of conventional high voltage DC contactors generally employ a sealed environment or chamber utilizing permanent magnets to laterally draw a metal phase electric arc. The drawn arc is then rapidly cooled and compounded in an arc extinguishing medium. However, the manufacturing process for these types arc extinguishing structures is complex, which results in higher costs. In addition, there is a risk that the arc extinguishing performance will decrease after a period of time due to gas leakage from the sealed chamber.

Accordingly, alternative arc extinguishing structures are desired.

SUMMARY

A contactor according to an embodiment of the present disclosure includes two static contacts, and a movable contact. Two ends of the movable contact are adapted to electrically contact with the two static contacts, respectively. The movable contact is mounted on a rotatable member which is rotatably mounted on a support plate. Two ceramic members are mounted on the support plate, with each defining an internal region. Two permanent magnets are also mounted on the support plate and located outside the two ceramic members, respectively. The two ends of the movable contact are located in respective internal regions of the two ceramic members such that an electrical arc generated between the movable contact and the static contact is located within the internal region of the ceramic member.

BRIEF DESCRIPTION OF THE DRAWINGS

The invention will now be described by way of example with reference to the accompanying Figures, of which.

DETAILED DESCRIPTION OF THE EMBODIMENTS

Figure 1:
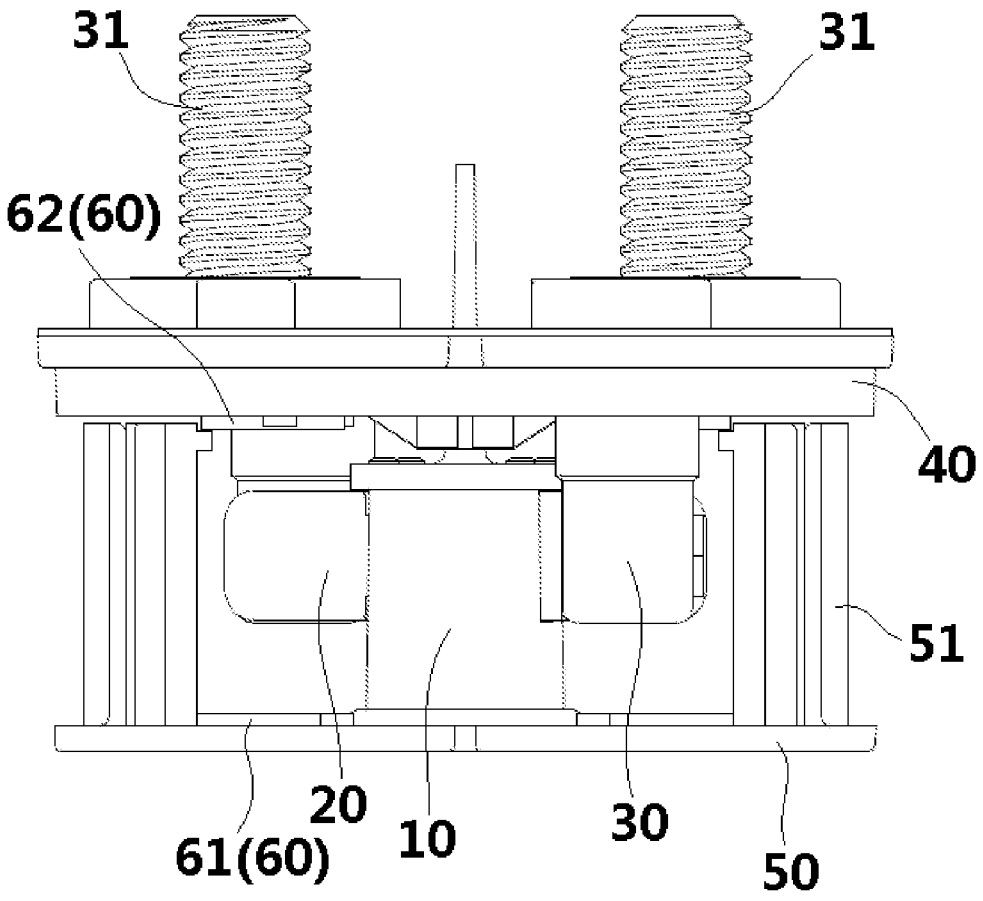
FIG. 1 shows a schematic perspective view of a contactor according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an embodiment of the present disclosure, a contactor includes two static contacts, and a movable contact. Two ends of the movable contact are adapted to electrically contact with the two static contacts, respectively. The contactor further includes a rotatable member rotatable about a central axis, with the movable contact being mounted on the rotatable member. A support plate is mounted on the rotatable member and is rotatable together with the rotatable member. Two ceramic members are mounted on the support plate, with each defining an internal region. Finally, two permanent magnets are mounted on the support plate and located outside the two ceramic members, respectively. The two ends of the movable contact are located in the internal regions of the two ceramic members respectively, such that an electric arc generated between the movable contact and the static contact is located within the internal region of the ceramic member.

Figure 2:
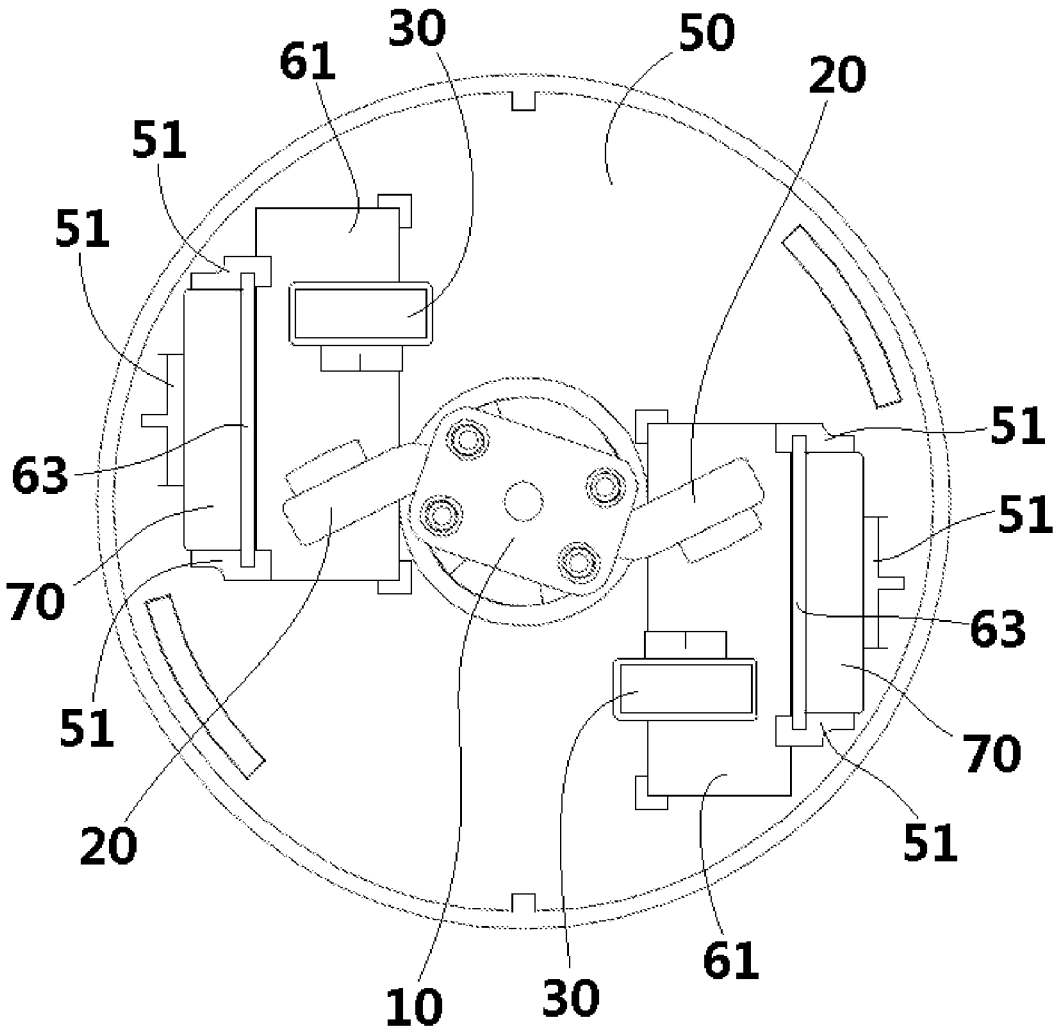
FIG. 2 shows a top view of the contactor shown in FIG. 1 with a top insulating member thereof removed.

FIG. 1 shows a schematic perspective view of a contactor according to an exemplary embodiment of the present disclosure. FIG. 2 shows a plan view of the contactor shown in FIG. 1. As shown in FIGS. 1 and 2, a contactor according to an embodiment of the present disclosure includes two static contacts 30 and a movable contact 20. Two ends of the movable contact 20 are adapted to simultaneously electrically contact the two static contacts 30 respectively for electrically connecting the two static contacts 30.

In the illustrated embodiment, the contactor further includes a rotatable member 10, a body including a support plate 50, two ceramic members 60 and two permanent magnets 70. The rotatable member 10 is rotatable about a central axis, and the movable contact 20 is mounted on the rotatable member 10. The support plate 50 is mounted on the rotatable member 10 and is rotatable therewith. The two ceramic members 60 are mounted on the support plate 50, with each defining an internal region. The two permanent magnets 70 are mounted on the support plate 50 and are located outside of the two ceramic members 60, respectively.

Each of the ceramic members 60 includes a bottom wall 61, a top wall 62, and a side wall 63 located between the bottom wall 61 and the top wall 62. The bottom wall 61 of each ceramic member 60 may be fixed on a top surface of the support plate 50. The internal region is defined by the bottom wall 61, the top wall 62 and the side wall 63. The two ends of the movable contact 20 are located within respective internal regions of the two ceramic members 60, such that an electrical arc generated between the movable contact 20 and the static contact 30 is located within the internal region of the ceramic member 60. In this way, the ceramic member 60 causes rapid cooling of the electrical arc, which greatly improves an electrical arc extinguishing effect.

Each of the two permanent magnets 70 is located outside the side wall 63 of the respective ceramic member 60, and is abutted against an outer side surface of the side wall 63. Each of the permanent magnets 70 has a height substantially equal to that of the side wall 63 of the respective ceramic member 60, and a width substantially equal to that of the side wall 63 of the respective ceramic member 60.

The surface of the support plate 50 is provided with two permanent magnet mounting chambers, into which the two permanent magnets 70 are embedded and mounted, respectively. Each of the permanent magnet mounting chambers is defined by a protruding wall 51 formed on the top surface of the support plate 50 and the side wall 63 of the respective ceramic member 60. The side wall 63 of each ceramic member 60 snap-fits with the protruding wall 51 of the support plate 50 at two sides thereof via the illustrated channels formed in the protruding wall (see FIG. 2). The protruding wall 51 of the support plate 50 has a height substantially equal to that of the respective permanent magnet 70. In one embodiment, each of the permanent magnet mounting chambers has a rectangular cross-section and each permanent magnet 70 is in a shape of a rectangular parallelepiped.

The rotatable member 10 may be formed in the shape of a rod and passes through the support plate 50, with the top surface of the support plate 50 perpendicular to the central axis of the rotatable member 10. The body of the contactor further includes an stationary insulation member 40 onto which the two stationary contacts 30 are fixed. Two connection bolts 31 are fixed on the stationary member 40 and are electrically connected to the two stationary contacts 30, respectively.

An object of the present disclosure is to design an air-type arc extinguishing structure, which can reduce the cost without inflation. Compared with the related art, the present disclosure has advantages of low cost, high arc extinguishing performance, simple manufacturing process and the like.

In the illustrated embodiment, the arc extinguishing structure includes the ceramic members and the permanent magnets (for example, permanent magnetic irons). The ceramic members are positioned around the contacts, and the permanent magnets are positioned near the contacts. The permanent magnets serve for magnetic blowing and arc extinguishing, and the ceramic members function as high insulation resistance to arc burning while cooling. The combination of the permanent magnets with ceramic members can significantly improve the arc extinguishing performance and the electrical life of the high-voltage direct current contactor.

The arc extinguishing structure can be used with a rotary contact system. When the contacts are rotated to be disconnected, the movable contact functions as arc striking and arc discharging, thereby a magnetic induction intensity applied to the electric arc can be enhanced during disconnection, which is more beneficial to the arc extinguishing. In addition, the arc discharging of a maximum path can be achieved by the permanent magnets and ceramic members of the arc extinguishing structure, and a high insulation performance of the internal medium can be ensured to achieve the rapid arc extinguishing.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A contactor, comprising:

two static contacts;

a movable contact having two ends for contacting the two static contacts, respectively;

a support plate;

a rotatable member rotatably mounted about a central axis on the support plate, the movable contact being mounted on the rotatable member;

two ceramic members mounted on the support plate, each of the two ceramic members defining an internal region, the two ends of the moveable contact being located in respective ones of the internal regions of the two ceramic members; and two permanent magnets mounted on the support plate and located outside of the two ceramic members, respectively.

2. The contactor according to claim 1, wherein each of the ceramic members includes a bottom wall, a top wall, and a side wall located between the bottom wall and the top wall, the internal region is defined by the bottom wall, the top wall and the side wall.

3. The contactor according to claim 2, wherein the bottom wall of each ceramic member is fixed on a top surface of the support plate.

4. The contactor according to claim 2, wherein each of the two permanent magnets is abutted against an outer side surface of the side wall of a corresponding one of the ceramic members.

5. The contactor according to claim 4, wherein each of the permanent magnets has a height substantially equal to that of the side wall of the corresponding ceramic member.

6. The contactor according to claim 4, wherein each of the permanent magnets has a width substantially equal to that of the side wall of the corresponding ceramic member.

7. The contactor according to claim 4, wherein a top surface of the support plate includes two permanent magnet mounting chambers into which a respective one of the two permanent magnets is mounted.

8. The contactor according to claim 7, wherein each of the permanent magnet mounting chambers is defined by the side wall of a corresponding ceramic member and a protruding wall formed on the top surface of the support plate.

9. The contactor according to claim 8, wherein the side wall of each ceramic member forms a snap fit with the respective protruding wall of the support plate at two sides thereof.

10. The contactor according to claim 8, wherein the protruding walls of the support plate have a height substantially equal to that of the respective permanent magnet.

11. The contactor according to claim 7, wherein each of the permanent magnet mounting chambers has a rectangular cross-section and each of the permanent magnets is in a shape of a rectangular parallelepiped.

12. The contactor according to claim 1, wherein the rotatable member is rod shaped and passes through the support plate, and a top surface of the support plate is perpendicular to the central axis of the rotatable member.

13. The contactor according to claim 1, further comprising a stationary insulation member on which the two stationary contacts are fixed.

14. The contactor according to claim 13, further comprising two connection bolts fixed to the stationary member and electrically connected to the two stationary contacts, respectively.

15. A contactor, comprising:

a body;

a first static contact and a second static contact fixed to the body;

a movable contact rotatably attached to the body and having first and second ends for selectively electrically contacting the first and second static contacts, respectively;

a first ceramic member and a second ceramic member each defining an internal region and fixedly mounted on the body, with the moveable contacts contacting the static contacts, the first and second ends of the moveable contact are arranged within in a respective one of the internal regions; and a first permanent magnet and a second permanent magnet mounted on the body and positioned outside of a respective one of the two ceramic members.

16. The contactor according to claim 15, wherein the internal regions are each defined by a bottom wall, a top wall, and a side wall of a respective ceramic member.

17. The contactor according to claim 16, wherein each of the first and second permanent magnets is abutted against an outer side surface of the side wall of a corresponding one of the first and second ceramic members.

18. The contactor according to claim 15, wherein the body includes:

a support plate on which the moveable contact is rotatably mounted; and a stationary insulation member arranged above the support plate and the first and second ceramic members, and onto which the two stationary contacts are fixed.

19. The contactor according to claim 18, wherein a top surface of the support plate includes two permanent magnet mounting chambers into which a respective one of the first and second permanent magnets is mounted.

20. The contactor according to claim 19, wherein each of the permanent magnet mounting chambers is defined by a side wall of a corresponding ceramic member and a protruding wall formed on the top surface of the support plate.

21. A contactor, comprising:

two static contacts;

a movable contact having two ends for contacting the two static contacts, respectively;

a support plate;

a rotatable member rotatably mounted about a central axis on the support plate, the movable contact being mounted on the rotatable member;

two ceramic members mounted on the support plate, each of the two ceramic members includes a bottom wall, a top wall, and a side wall located between the bottom wall and the top wall defining an internal region, the two ends of the moveable contact being located in respective ones of the internal regions of the two ceramic members; and two permanent magnets mounted on the support plate and located outside of the two ceramic members, respectively, each of the two permanent magnets is abutted against an outer side surface of the side wall of a corresponding one of the ceramic members, a top surface of the support plate includes two permanent magnet mounting chambers into which a respective one of the two permanent magnets is mounted, each of the permanent magnet mounting chambers is defined by the side wall of a corresponding ceramic member and a protruding wall formed on the top surface of the support plate, the side wall of each ceramic member forms a snap fit with the respective protruding wall of the support plate at two sides thereof.

* * * * *